US005887629A

United States Patent [19]

Mettler et al.

[11] Patent Number: 5,887,629

[45] Date of Patent: Mar. 30, 1999

[54] CORNER CONNECTION FOR A HEDDLE SHAFT

[75] Inventors: Franz Mettler, Wollerau; Hans Baumann, Horgen, both of Switzerland

[73] Assignee: Grob & Co. Aktiengesellschaft, Horgen, Switzerland

[21] Appl. No.: 824,119

[22] Filed: Mar. 26, 1997

[30] Foreign Application Priority Data

Mar. 28, 1996 [DE] Germany ..... 196 12 404.2

[51] Int. Cl.[6] ..... D03C 9/06

[52] U.S. Cl. ..... 139/91; 403/363

[58] Field of Search ..... 139/91; 403/363

[56] References Cited

U.S. PATENT DOCUMENTS

| | | | |
|---|---|---|---|
| 3,335,759 | 8/1967 | Koch | 139/91 |
| 4,741,367 | 5/1988 | Kitawaki | 139/91 |
| 4,753,273 | 6/1988 | Gaisser | 139/91 |
| 5,005,607 | 4/1991 | Shimizu | 139/91 |
| 5,297,589 | 3/1994 | Baumann | 139/91 |
| 5,483,996 | 1/1996 | Mettler | 139/91 |

FOREIGN PATENT DOCUMENTS

| | | |
|---|---|---|
| 0189216 | 1/1986 | European Pat. Off. . |
| 0328951 | 8/1989 | European Pat. Off. . |
| 0502383 | 9/1992 | European Pat. Off. . |
| 3308371 | 5/1984 | Germany . |
| 4038384 | 12/1992 | Germany . |
| 2132681 | 5/1990 | Japan . |
| 355865 | 5/1991 | Japan . |
| 404580 | 5/1966 | Switzerland . |
| 288681 | 1/1971 | U.S.S.R. . |
| 925562 | 5/1963 | United Kingdom . |

*Primary Examiner*—Andy Falik

*Attorney, Agent, or Firm*—Watson Cole Grindle Watson, P.L.L.C.

[57] ABSTRACT

A heddle shaft is formed of shaft rods which have hollow ends containing inserts fixedly positioned therein and lateral supports which include projections that respectively extend into recesses in the inserts. Clamping screws, which can extend through the shaft rods, apply a compressive force to clamp the projections in place and create detachable corner connections between the shaft rods and the lateral supports.

12 Claims, 4 Drawing Sheets

CORNER CONNECTION FOR A HEDDLE SHAFT

BACKGROUND OF THE INVENTION

The invention relates to a heddle shaft having detachable corner connections. More specifically, the invention relates to a heddle shaft wherein the shaft rods include hollow sections into whose hollow space, at each corner connection, a projection extending laterally from the lateral support fits in a plug-like fashion and is clamped by a clamping means.

Heddle shafts usually consist of four basic elements, namely two support rods and two lateral supports connected to the support rods. The point of connection of the support rods with the lateral supports is referred to as a corner connection. In the case of so-called sliderless heddle shafts, when a new warp is to be drawn in, the entire shaft packet is removed from the loom and brought into the drawing-in room. In order to remove the heddles and to draw in new heddles, one of the two lateral supports is usually disconnected. It is obvious that a corner connection wherein the lateral supports can be quickly and easily detached from the shaft rod, and which can be just as quickly reconnected, is advantageous for weaving, because in most cases a lateral support must be removed to draw in new warp threads. In addition, the mounted lateral support must be positioned very precisely in relation to the support rods. If this is not done, disturbances will occur in the weaving operation, causing considerable costs.

Many constructions are in use that meet both requirements. One of the most successful and simplest constructions is disclosed in DE 33 08 371. This construction is based essentially on a projection of the lateral support being braced in the hollow space of the shaft rod by means of a pressure screw. Similar designs operating with the same principle of a pressure screw are found in EP 0 189 216, EP 0 328 953 and DE 40 38 384.

A further construction, though not quite so easy to handle, uses a draw-screw and a wedge which is clamped directly or indirectly in the hollow space of the shaft rod. Such constructions are disclosed in GB 925 562, SU 288 681, JP H3-55865 and CH 404 580. Also proposed have been elements which are movable around a pivot for bracing in the hollow space of the shaft rod, e.g., in EP 0 502 383. JGM H2-132 681 discloses a U-shaped element that is used for clamping a projection of a lateral support, once again by means of a pressure screw.

All of these designs (and there are still more than those listed) have in common that a bracing in the hollow space of the shaft rod occurs which considerably stresses the lateral walls of the shaft rods. Since compared to this prestressing the operating tensions created by the upward and downward motion of the heddle shafts are relatively low, such constructions can be used without a problem up to medium rotational speeds. But the continuously increasing rotational speeds of the loom increase the operating tensions so much that, although no overload breakages occur, fatigue fractures occur fairly quickly. The insertion of elastic parts does not provide a solution, because the level of stress is not reduced by doing so; rather, if anything, it only results in a somewhat reduced fracture frequency. The reinforcement by means of a box-type insert, used in DE 40 38 384, is no longer sufficient at very high rotational speeds either. Only EP 0 189 216 in FIGS. 4 and 5 shows a projection that does not impact the lateral walls of the shaft rod with the initial tension of the clamping screw. On the other hand, the projection of the lateral support that fits into the shaft rod is subjected to strain with these forces. It is also known that it is out of the question to mount a thread with sufficient diameter in the projection of the lateral support for the forces required nowadays. Furthermore, the shaft rod is weakened too much by the slot needed for the screw. Thus, although these are the proper rudiments of a solution to the problem, the proposed design is not realizable in practice.

It is therefore an object of the present invention to create a detachable corner connection for a weaving frame which is able to absorb the bracing and/or prestressing forces which occur during assembling as well as the stresses occurring during operation, and which also allows simple detachment and simple remounting.

SUMMARY OF THE INVENTION

According to the invention, this object is achieved by means of a heddle shaft with detachable corner connections wherein the shaft rod of the heddle shaft is hollow at least one end and wherein the elongated lateral support adjacent each hollow at end includes a side projection which extends into the hollow end, wherein an insert element having a channel extending inwardly from a side thereof is fixedly attached to the shaft rod at each hollow end so that the side projection can extend into the channel, and a clamping mechanism is provided for clamping the lateral projection in the channel, this mechanism applying a force on the side projection which is generally parallel with the elongated lateral support.

According to the present invention the prestressing stress is separated in its action from the operating stress and, at the same time, the proven simple functioning with a pressure screw for bracing a projection of the lateral support in the hollow space of the shaft rod can be maintained. An insert having a channel is mounted into the hollow space of the shaft rod such that the channel, which can be provided by a U-shaped or a pincer-shaped portion of the insert, faces the side support and receives the projection of the lateral support. The projection of the lateral support is clamped in known manner, for example, with a pressure screw, in this channel. The thread for the pressure screw is situated in an upper leg of the pincer-shaped or U-shaped portion of the insert. In this way, and of course by appropriate sizing of the U-shaped or pincer-shaped portion, the entire prestressing force is absorbed in the insert according to the invention. The insert itself is attached in the shaft rod at its end opposite the U-shaped or pincer-shaped legs. This attachment now transfers only the forces from the operation of the heddle shafts, however, and does not have to absorb any prestress at all. In this way, the level of stress in the side walls of the shaft rods is reduced enough that fatigue fractures no longer occur.

It should be noted that the clamping screw which is preferably used in the invention can of course be replaced with other appropriate clamping means; the important thing is that the gripping and/or prestressing forces during mounting of the corner connection are transferred from the heddle shaft via the insert onto the projection of the lateral support whereby the entire gripping and/or prestressing force is absorbed by the insert.

The invention will now be explained in greater detail with reference to the attached figures, taken in conjunction with the following discussion.

DETAILED DESCRIPTION OF THE PREFERRED EMBODIMENTS

Figure 1:
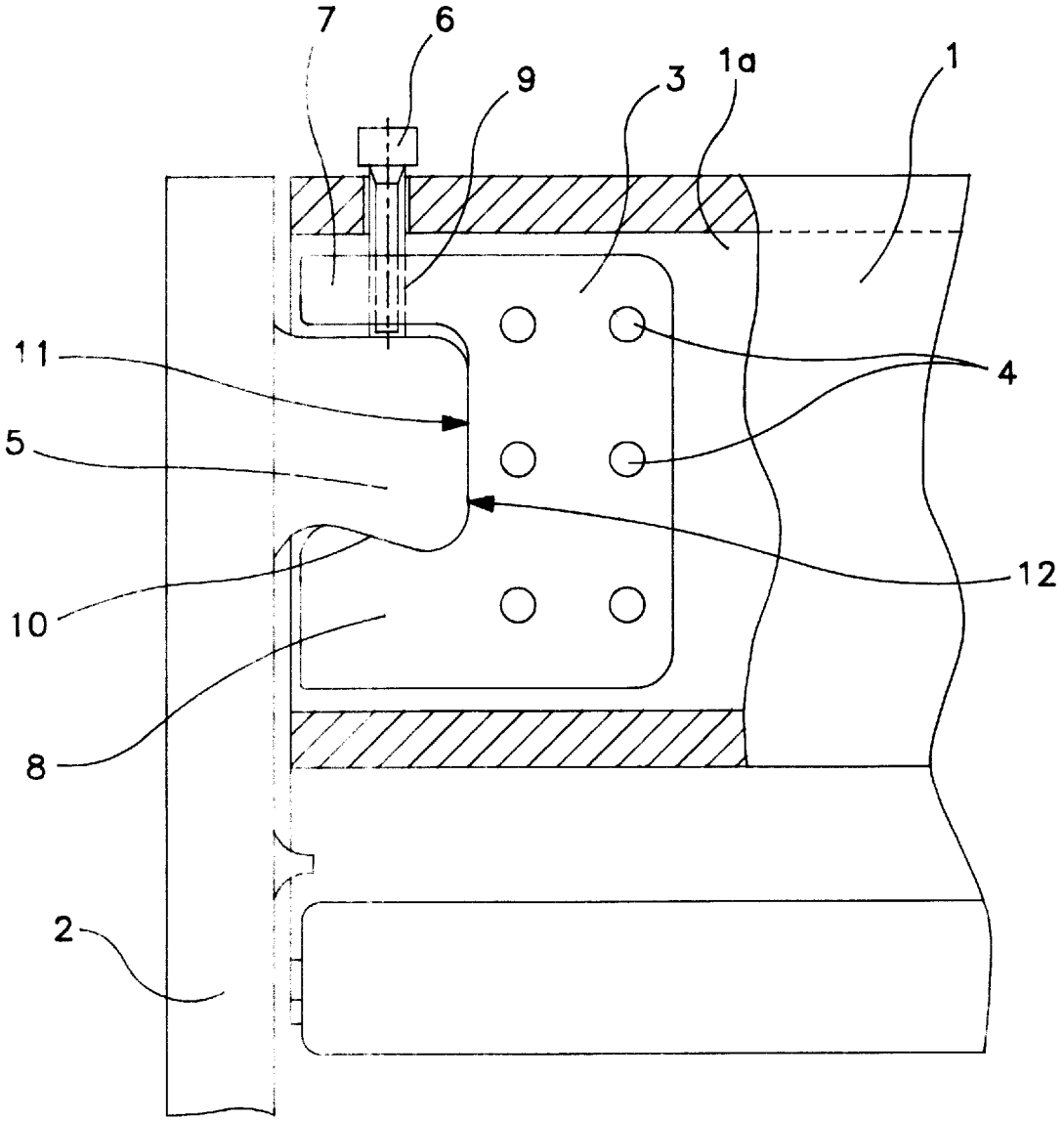
FIG. 1 shows a partially broken away corner connection part of a heddle shaft utilizing an insert according to the invention.

FIG. 1 shows a partially broken away corner connection part of a heddle shaft with an insert 3 according to the invention. The insert 3 is connected within a hollow end 1*a* of a support rod 1 of the heddle shaft by means of rivets 4. The lateral support 2 includes a projection 5 which is attached by means of a screw 6 that is screwed into thread 9 in the first part 7 of the pincer-shaped portion of the insert. This screw 6 presses the projection 5, located in the channel between the first part 7 and a second part 8, against the second part 8 of the pincer-shaped portion of the insert. This part 8 also has an inclination 10 which ensures that the projection 5 of the side support 2 is drawn into the pincer-shaped portion of the insert 3 until the surface 11 of the projection 5 lies against the surface 12 of the insert 3. In this way, an exact positioning of the lateral support 2 is achieved in relation to the insert 3 and thus also the support rod 1.

Figure 2:
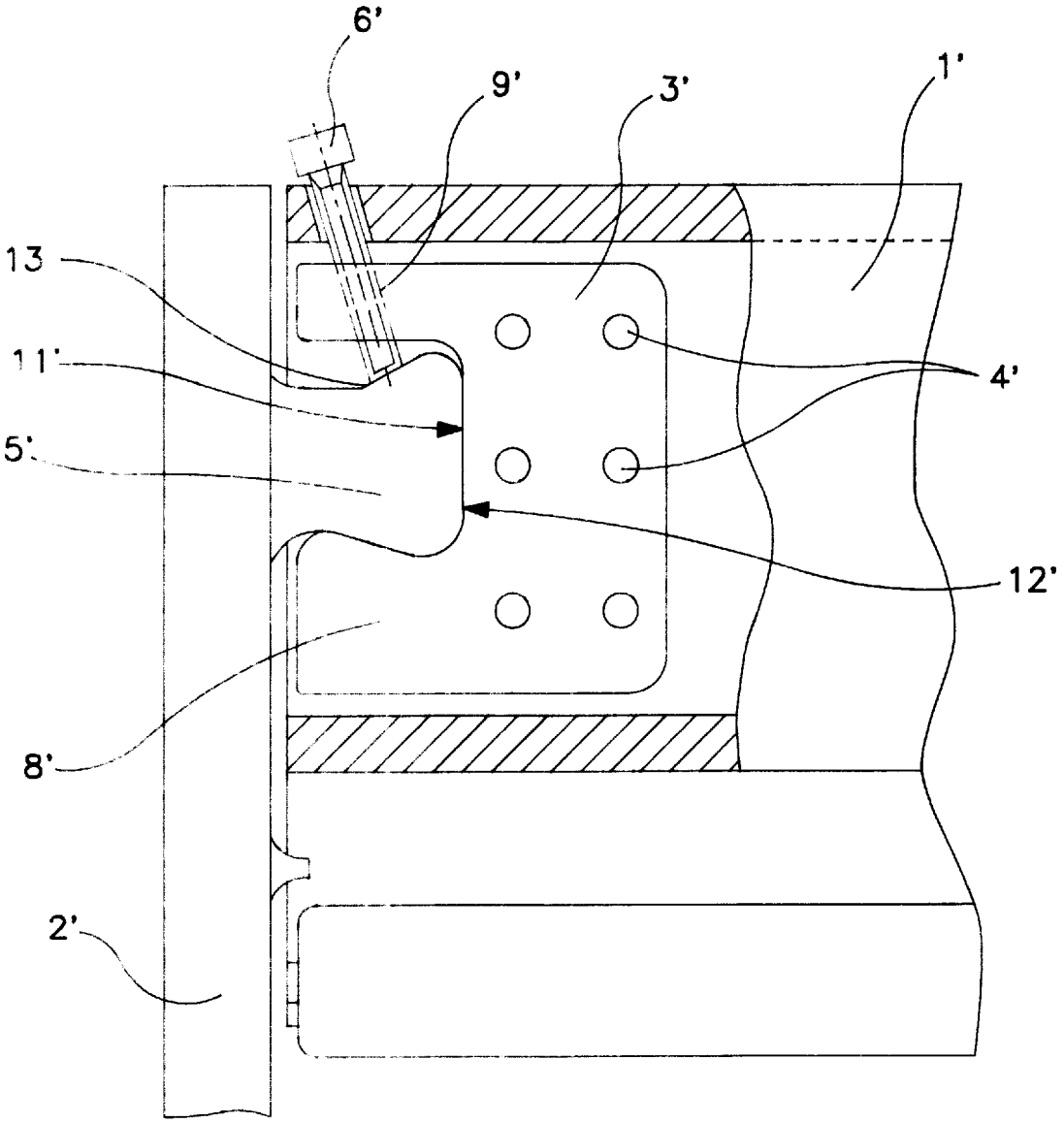
FIG. 2 shows a further embodiment of a corner connection utilizing a modified embodiment of an insert according to the invention.

FIG. 2 shows a further embodiment of the insert, in this instance designated by 3'. The thread 9' is inclined in relation to the axis of the lateral support 2' and presses against an inclination 13 on the projection 5'. The lower part 8' of the pincer-shaped portion of the insert 3' does not have an inclination in this case. The pressure of the screw 6' is sufficient to press the lateral support 2' against the insert 3'.

Figure 3:
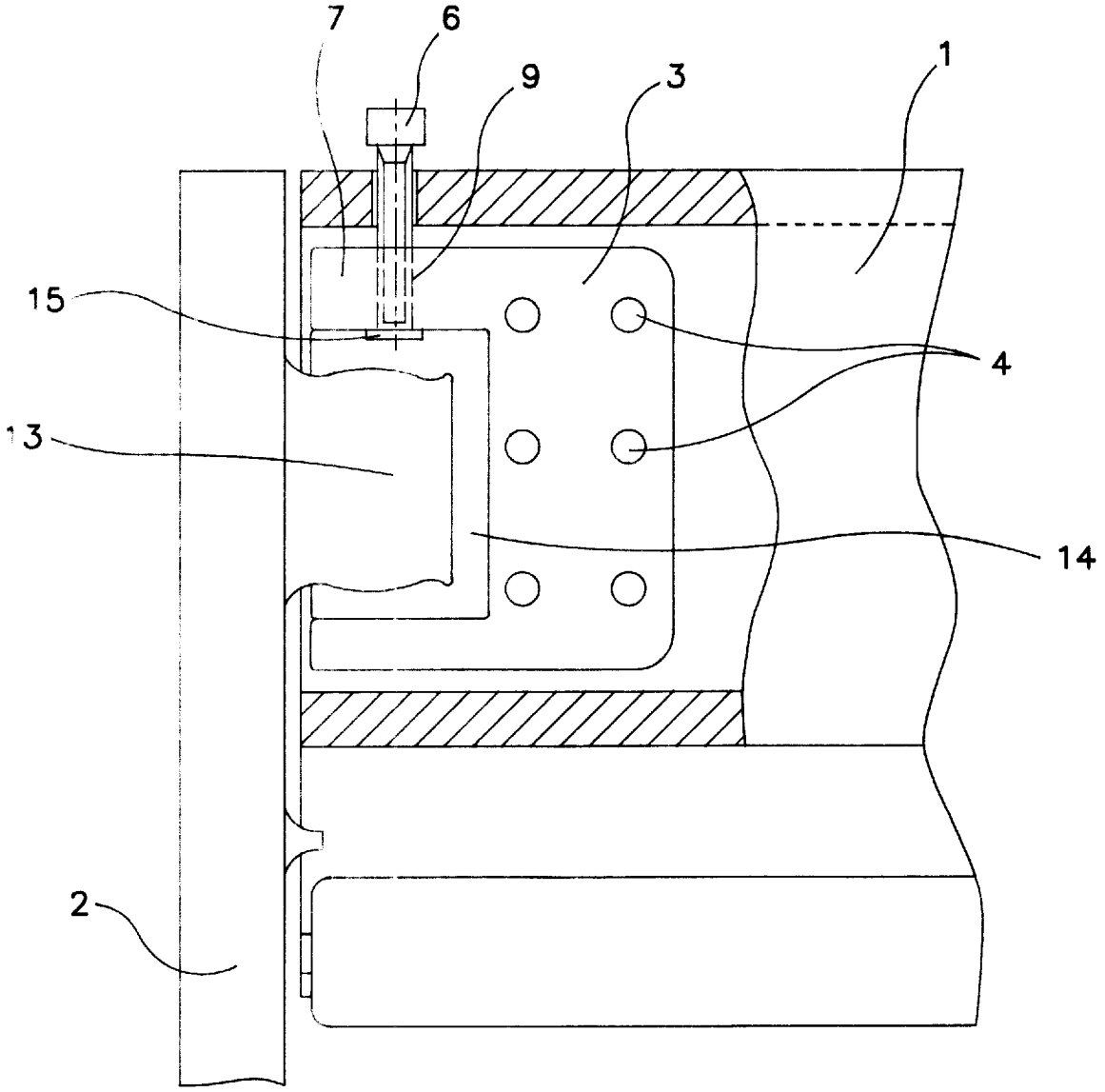
FIG. 3 shows another embodiment of a corner connection utilizing an elastic bearing part arranged between the projection and the inventive insert.

FIG. 3 shows a further embodiment of a corner connection according to the invention whereby the insert 3 receives an elastic bearing part 14 which is intended to act in a vibration-reducing manner and is mounted around a projection 13 of the lateral support 2. The screw 6 acts on the projection 13 of the lateral support by means of a pad 15 that serves to protect the elastic part, and braces the projection according to the invention in the insert 3. The particular embodiment of insert to be used with the support rod of the heddle shaft is adapted to the materials of the insert and the support rod. The insert is preferably made of tempered steel. When the support rod consists of aluminum, the connection of the two parts is preferably achieved with rivets. If the support rod is made of steel, then welding will be the preferred method of connection. For support rods of plastic, glueing will be the connection method of choice.

Figure 4:
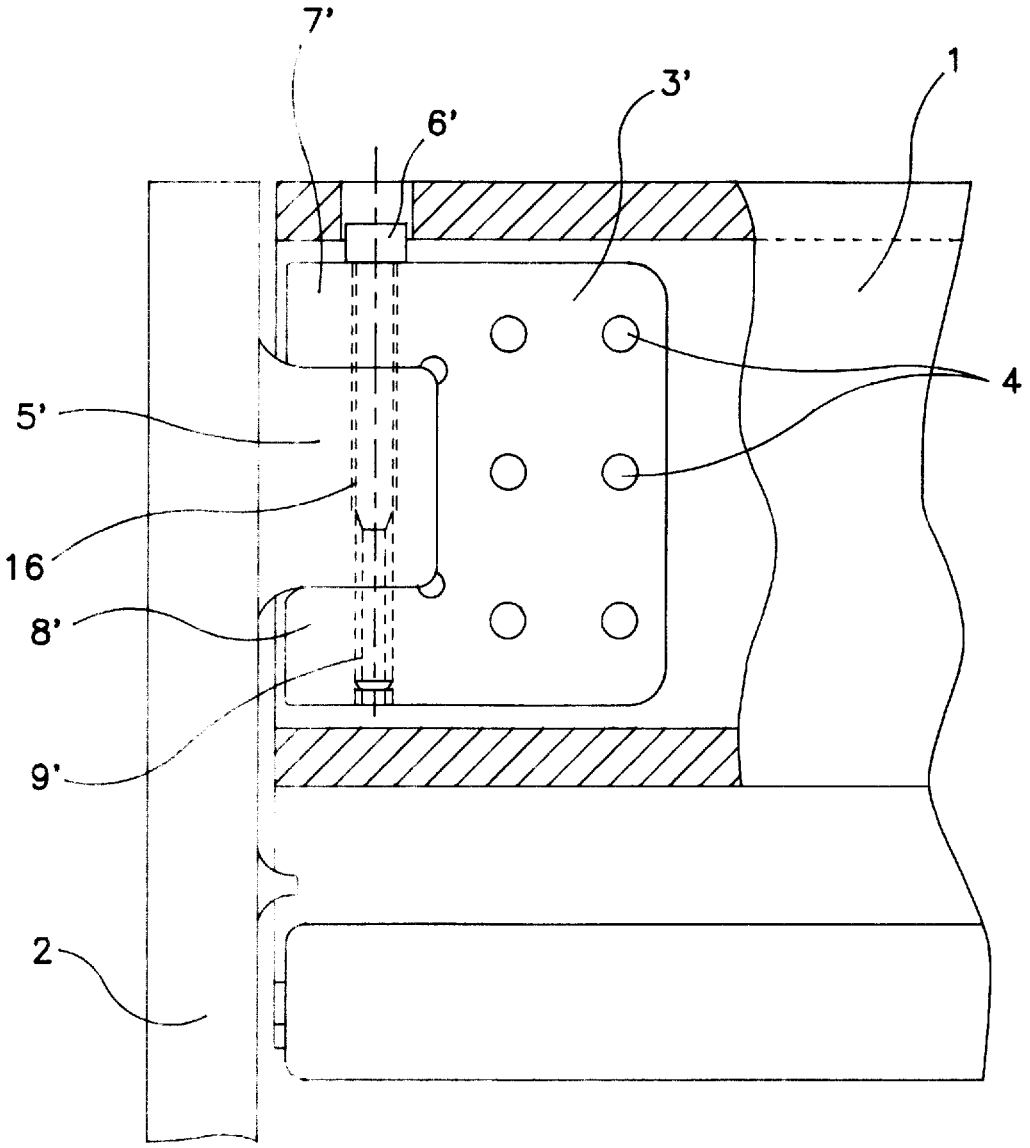
FIG. 4 shows a still further embodiment of a corner connection utilizing a further embodiment of an insert according to the invention.

FIG. 4 shows a corresponding embodiment of the invention with a pincer-shaped insert 3' which is stressed when the two projections 7' and 8' are drawn together. For this purpose, the projection 5' of the lateral support 2 has a bore 16 that a pressure screw 6' penetrates. The screw 6' is a draw-screw that fits into the thread 9' in the projection 8'. When the screw 6' is tightened, the two projections 7' and 8' are drawn toward each other and thus clamp the projection 5' of the lateral support 2 in the insert 3'. The action according to the invention, namely the absorption of prestressing strains in an insert that is attached in the shaft rod without subjecting it to the prestressing strain, is thereby also achieved in this manner.

The connection method has no substantial influence on the function of the insert according to the invention. But it must take place in a manner that positions the insert firmly in the support rod and does not hinder the pincer-shaped part in the small deformation that results from the bracing of the projection of the lateral support by means of the pressure screw.

The corner connections shown in FIGS. 1–4 are of course examples that can be altered, modified or completed as desired. Thus, in particular the inserts shown in the figures, their connection with the hollow space walls of the support rods, as well as the clamping means chosen in the form of a screw, are not limited to the forms of execution shown. Thus, for example, it is also possible to weld, glue or screw the insert together with the hollow space walls of the support rod. The insert can also be a pincer in the true sense of the word, whose pincer legs can fit in clamping manner into corresponding reliefs of the projection. Instead of the aforementioned screw, it is also possible to use a tensile gripping mechanism comprising bolts, for example, or other suitable clamping means. It is essential to the invention that in the hollow space of the support rod, an insert is arranged that has a receptacle or channel for receiving a projection of the lateral support, which projection is held in the receptacle of the insert by gripping and/or prestressing forces acting at almost parallel to the lateral support.

I claim:

1. Heddle shaft comprising lateral supports and shaft rods and having a detachable corner connection between at least one of the lateral supports and at least one of the shaft rods, the shaft rods consisting of hollow sections and into whose hollow space, at each corner connection, a projection extending transversely from the lateral support fits plug-like and is clamped by at least one detachable clamping means, wherein non-elastic insert that has first and second legs defining a generally U-shaped or pincer-shaped receptacle open toward the lateral support and intended to receive the plug-like projection is located in the hollow apace and is fixedly connected to the respective shaft rod, and said clamping means includes at least one screw which threadingly extends through a threaded hole in said first leg of said insert to apply a force toward the plug-like projection and in a direction substantially parallel to the lateral support in order to hold in a clamping manner the projection in the receptacle.

2. Heddle shaft according to claim 1, wherein said second leg of the U-shaped or pincer-shaped insert opposite said first leg (7) has a support (10) inclined in relation to a longitudinal axis of the shaft rod, and the projection of the lateral support has a correspondingly inclined supporting surface.

3. Heddle shaft according to claim 1, wherein the force applied by the clamping means is directed at an inclination toward the projection in such a way that the clamping or gripping force is directed along a line which diverges from the lateral support.

4. Heddle shaft according to claim 1, wherein said threaded hole extends at an angle of less than 90° with the longitudinal axis of the support rod.

5. Heddle shaft according to claim 1, wherein said at least one screw comprises a draw-screw which extends through each of said first and second legs of the U-shaped or pincer-shaped insert and through the projection, whereby the draw-screw, at least in a front area, can be screwed in a thread (9') in the second leg (8') of the generally U-shaped insert.

6. Heddle shaft comprising lateral supports and shaft rods and having a detachable corner connection between at least one of the lateral supports and at least one of the shaft rods, the shaft rods consisting of hollow sections and into whose hollow space, at each corner connection, a projection extending transversely from the lateral support fits plug-like, wherein a non-elastic insert that has a receptacle open toward the lateral support and intended to receive the plug-like projection is located in the hollow space, securing means for fixing each insert in said hollow space of each respective shaft rod comprising rivets, a weld joint or gluing, and including at least one clamping means to create a gripping and/or clamping force directed toward the plug-like projection in a direction substantially parallel to the lateral support in order to hold in a clamping manner the projection in the receptacle.

7. Heddle shaft according to claim 6, wherein the clamping means includes at least one pressure screw.

8. A heddle shaft which includes the shaft rod defining a hollow interior at one end thereof and an elongated lateral support which includes a side projection that is removably positionable in said hollow interior; a one-piece insert element located in said hollow interior of said shaft rod, said insert element providing a channel into which said projection can extend; securing means for fixedly positioning said insert element in said shaft rod; and clamping means for clamping said projection within said channel of said insert element and connecting said lateral support to said shaft rod, said clamping means applying a force towards said projection in a direction generally parallel with said elongated lateral support.

9. A heddle shaft according to claim 8, wherein said insert provides an upper leg and a lower leg that defines a U-shaped portion which provides said channel.

10. A heddle shaft according to claim 9, wherein said clamping means comprises a threaded screw which extends through said upper leg to contact said projection and press said projection against said lower leg.

11. A heddle shaft according to claim 8, wherein said insert provides an upper leg and a lower leg that defines a pincer-shaped portion which provides said channel.

12. A heddle shaft according to claim 11, wherein said clamping means comprises a threaded screw which extends through said upper leg to contact said projection and press said projection against said lower leg.

* * * * *